US005418561A

United States Patent [19]

Fujioka

[11] Patent Number: 5,418,561

[45] Date of Patent: May 23, 1995

[54] INK JET PRINTER HAVING HOT MELT INK SUPPLYING DEVICE

[75] Inventor: Masaya Fujioka, Nagoya, Japan

[73] Assignee: Brother Kogyo Kabushiki Kaisha, Nagoya, Japan

[21] Appl. No.: 944,331

[22] Filed: Sep. 14, 1992

[30] Foreign Application Priority Data

Sep. 17, 1991 [JP] Japan ..... 3-267085

[51] Int. Cl.[6] ..... B41J 2/175

[52] U.S. Cl. ..... 347/88; 347/17

[58] Field of Search ..... 346/75, 1.1; 222/140 R, 222/146.1, 146.2; 347/88, 99, 17

[56] References Cited

U.S. PATENT DOCUMENTS

| | | | |
|---|---|---|---|
| 4,490,731 | 12/1984 | Vaught | 346/140 R |
| 4,951,067 | 8/1990 | Spehrley, Jr. | 347/88 |
| 4,998,120 | 3/1991 | Koto et al. | 346/140 R |
| 5,123,961 | 6/1992 | Yamamoto | 106/31 |
| 5,235,350 | 8/1993 | Lin et al. | 346/140 R |

FOREIGN PATENT DOCUMENTS

| | | | |
|---|---|---|---|
| 0097823 | 1/1984 | European Pat. Off. | 346/140 R |
| 62-3953 | 4/1987 | Japan | 346/140 R |
| 62-135375 | 6/1987 | Japan . | |

*Primary Examiner*—Benjamin R. Fuller
*Assistant Examiner*—John Barlow
*Attorney, Agent, or Firm*—Oliff & Berridge

[57] ABSTRACT

An ink jet device for an ink jet printer capable of minimizing the deterioration of the heat melted ink so as to produce printing having high stability and reliability. The ink heating temperature in the ink supply channel of the ink jet device is set to a lower temperature than the heating temperature in the ink jet part. Therefore, the heat melted ink is supplied into the ink jet part from the ink supply channel under a high viscosity but flowable condition. The heat melt ink is then supplied into the ink jet part where it is heated to a low viscosity condition so that it can be jetted.

14 Claims, 5 Drawing Sheets

FIG.4

| INK | MELTING POINT [°C] | FIRST TEMPERATURE | SECOND TEMPERATURE |
|---|---|---|---|
| A | $A_0$ | $A_1$ | $A_2$ |
| B | $B_0$ | $B_1$ | $B_2$ |
| C | $C_0$ | $C_1$ | $C_2$ |
| D | $D_0$ | $D_1$ | $D_2$ |

34A

INK JET PRINTER HAVING HOT MELT INK SUPPLYING DEVICE

BACKGROUND OF THE INVENTION

1. Field of the Invention

The invention relates to an ink jet printer employing heat melted ink and to an ink jet device of the ink jet printer.

2. Description of Related Art

An ink jet printer capable of printing an image, such as characters and figures on a recording medium, by employing heat melted ink which is a solid under a normal temperature and is melted by the application heat is well known. The ink jet printer comprises an ink jet device for jetting the melted heat melted ink, based on image data, toward the recording medium. Generally, in the ink jet device, the heat melted ink is heated by a single heating element or a plurality of heating elements which heat at the same temperature. In either case, the heat melted ink is heated so as to reach a predetermined temperature. Thus, the heat melted ink is melted by the heat element and becomes a liquid. At this time, the heat melted ink has a jettable low viscosity. In other words, the ink jet device keeps all stored ink in a melted condition at all times so as to be able to jet the ink at any time.

On the other hand, another ink jet device comprising a first and a second heat element is also well known. The first heat element melts the ink so that it becomes a liquid. At this time, the ink has a jettable low viscosity. The second heat element rapidly further heats the ink in order to give a heat energy to the ink. The heat energy is a jet power for the ink. According to the jet power, the ink is jetted. The ink jet device of this second type is disclosed in Japanese Laid-Open Patent Publication No. 62-135375.

However, in the above-mentioned ink jet device, the melted ink is stored in the ink jet device so as to maintain the jettable low viscosity for a long time. In other words, since the ink is kept at a high temperature, the ink is always kept in the melted condition. Therefore, the following problems result. When the ink is kept at a high temperature in order to be in the melted condition for a long time, the heat causes the ink composition to deteriorate. As a result, the characteristics of the ink, for example, the color and viscosity of the ink change as time passes. Therefore, when an image is formed using the deteriorated ink, the image does not have a good printing quality. Moreover, when the ink comprising pigment as a color material is kept at a high temperature in order remain in the melted condition for a long time, subsidence and aggregation of the pigment result. As a result, an ink jet part (jet nozzle) is clogged or the characteristics of the ink, for example, the color or viscosity of the ink, are changed or both.

SUMMARY OF THE INVENTION

It is therefore an object of the invention to provide an ink jet device with high reliability that does not cause a deterioration in the ink's characteristics as time passes. Moreover, it is another object of the invention to provide an ink jet device capable of preventing subsidence and aggregation of the pigment.

To achieve the above-mentioned objects, an ink jet device provided in an ink jet printer employing heat melted ink, which is a solid under a normal temperature and is melted by heating, comprises: an ink supply part for supplying heat melted ink under a first viscosity condition; and an ink jet part which is connected to the ink supply part and is able to jet the ink after bringing the heat melted ink supplied from the ink supply part to a second viscosity condition whose viscosity is a lower value than that of the first viscosity condition.

According to the invention having the above-mentioned structure, the ink supply part supplies the heat melted ink toward the ink jet part under the first viscosity condition. The ink jet part heats the heat melted ink supplied from the ink supply part under the first viscosity condition such that the ink is brought to the second viscosity condition at which the ink can be jetted.

BRIEF DESCRIPTION OF THE DRAWINGS

A preferred embodiment of the invention will be described in detail with reference to the following figures wherein:

FIG. 4 portrays a conceptual table of the ROM; and

DETAILED DESCRIPTION OF THE PREFERRED EMBODIMENT

Figure 1:
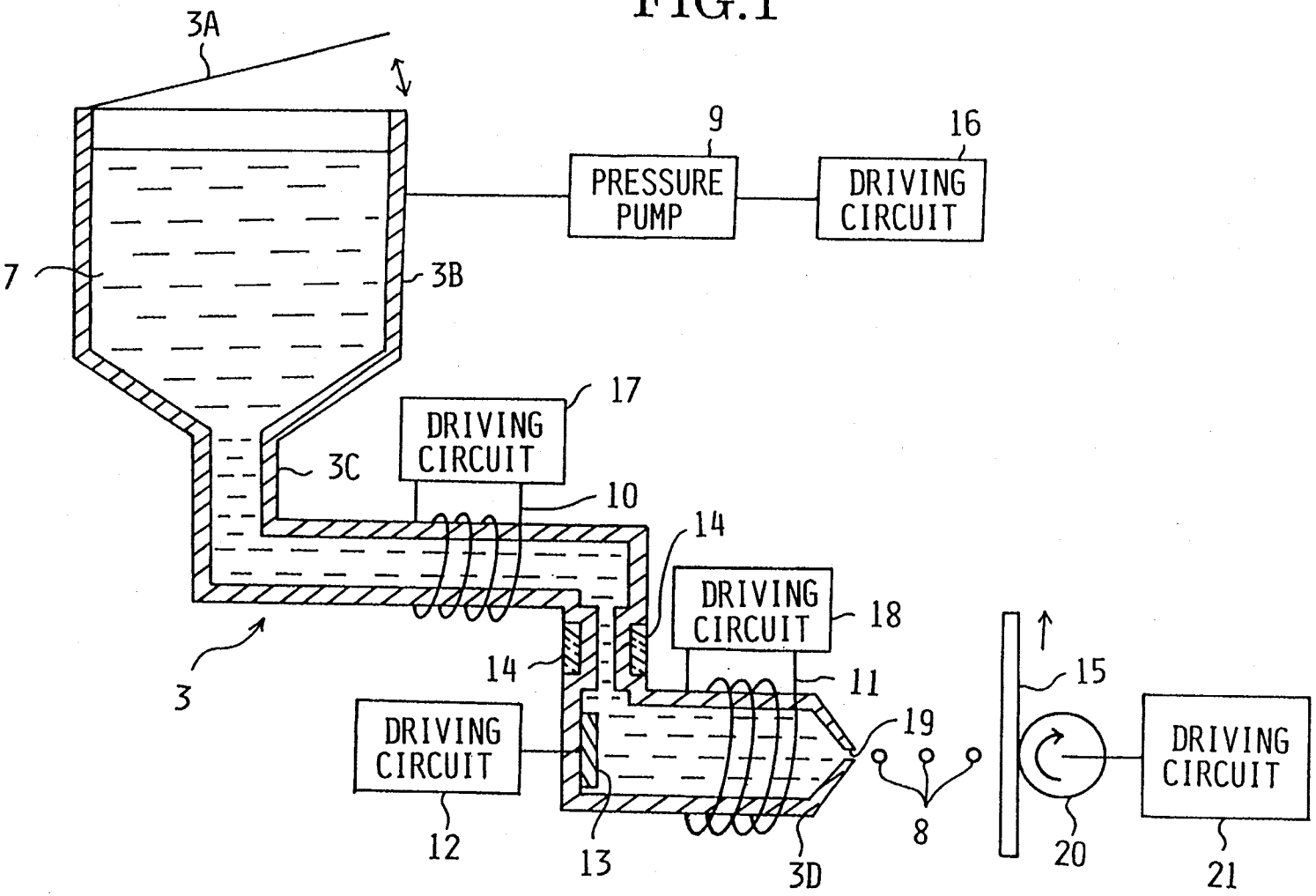
FIG. 1 is a partial schematic view showing an ink jet printer comprising an ink jet device.

Hereinafter, an embodiment of the invention will be explained with reference to the figures.

First, the structure of an ink jet printer comprising the ink jet device of the present embodiment will be explained with reference to FIGS. 1 and 2.

The ink jet printer generally comprises an ink jet device main body 3 and a sheet feeding part.

The ink jet device 3 comprises a cover 3A, an ink storing part 3B, an ink supply channel 3C and an ink jet part 3D. Further, the ink storing part 3B, the ink supply channel 3C and the ink jet part 3D are made of metal, which conducts heat well and has good non-corrosive characteristics, and are constructed integratedly. The ink jet printer itself comprises a plurality of ink supply channels 3C and a plurality of ink jet parts 3D. However, in order to explain the present embodiment simply, one ink supply channel 3C and one ink jet part 3D will suffice for explanation.

The cover 3A covers the opening of the ink storing part 3B except when a heat melted ink (hereinafter, referred to as an ink) 7 is supplied. When the ink 7 in the ink jet device 3 is consumed, the user opens the cover 3A and supplies the ink 7 into the ink jet device 3 through the opening of the ink storing part 3B.

The ink storing part 3B stores the supplied ink 7 therein. A pressure pump 9 is connected to the ink storing part 3B. The pressure pump 9 is also connected to CPU 32 through a driving circuit 16, to be described later, and applies pressure to the ink 7 stored in the ink storing part 3B. The pressure applied by the pressure pump 9 is controlled by the CPU 32 according to the ink consumption amount of each ink jet part 3D.

The ink supply channel 3C is a channel for connecting the ink storing part 3B and the ink jet part 3D. Therefore, the ink 7 in the ink storing part 3B is supplied into the ink jet part 3D through the ink supply channel 3C. Moreover, a first heater 10, which is the first heating means, is a coil heater and is wound around the ink supply channel 3C. The first heater 10 is connected to the CPU 32 through a driving circuit 17 and is controlled to heat the ink 7. The ink 7 is heated by the first heater 10 until the ink reaches a first temperature set by RAM 36, to be described later. The first heater 10 uniformly heats the whole of the ink storing part 3B and the ink supply channel 3C such that they reach and are maintained at the first temperature. The ink 7, which is supplied as a solid, melts to become a liquid ink having a high viscosity. The ink 7 in the melted liquid condition, having a high viscosity, flows toward the ink jet part 3D because of the pressure of the pressure pump 9. The ink storing part 3B and the ink supply channel 3C constitute the ink supply part of the invention.

The ink jet part 3D temporarily stores the ink 7 supplied from the ink supply channel 3C and jets the ink 7 based on image data. The ink jet part 3D has a jet nozzle 19 (an ink jet point), for jetting the ink 7, and a second heater 11, which is the second heating means. The second heater 11 is a coil heater that is wound around the ink jet part 3D. Moreover, the second heater 11 is connected to the CPU 32, through a driving circuit 18, and is controlled by the CPU 32 to further heat the ink 7. The ink 7 is heated by the second heater 11 until the ink 7 reaches a second temperature set by RAM 36, to be described later. The second heater 11 heats the ink 7, supplied from the ink supply channel 3C to the ink jet part 3D by the pressure of the pressure pump 9, such that the ink 7 reaches the second temperature. At that time, the ink 7 is in a melted liquid condition having a low viscosity so that it can be jetted. The second temperature is higher than the first temperature.

A piezoelectric element 13 is disposed fixedly inside the ink jet part 3D and is set so as to be perpendicular to the ink jet direction with respect to the jet nozzle. The piezoelectric element 13 is connected to the CPU 32 through a driving circuit 12. After the ink 7 is heated by the second heater 11 to the melted liquid condition having a low viscosity so that it may be jetted, the ink 7 is given the jet energy by the vibration of the piezoelectric element 13, and the ink 7 is jetted from the jet nozzle 19. As a result, an ink droplet 8 is formed according to the vibration cycle of the piezoelectric element 13 when the piezoelectric element 13 vibrates based on the image data.

During image formation, that is the time when ink droplets 8 are being ejected, the ink jet device 3 is controlled to move in a direction that is perpendicular to the arrow shown in FIG. 1 and is perpendicular to the flying direction of the ejected ink droplet 8. Thus, movement of the ink jet device 3 is in a line across the surface of a printing paper 15. The arrow shown in FIG. 1 shows the feeding direction of the printing paper 15. Moreover, if an ink jet operation can be executed smoothly, as is the case in the invention, a small capacity ink jet part 3D is better than a large capacity ink jet part 3D.

The ink supply channel 3C and the ink jet part 3D are connected by a narrow channel around which insulating member 14 is wound. This insulating member 14 is made of an insulating brick, and is provided so as to surround the narrow channel. The insulating member 14 is used to obstruct the heat conduction between the ink supply channel 3C and the ink jet part 3D. Therefore, the high temperature supplied to the ink jet part 3D is not conducted to the ink supply channel 3C.

A roller 20 is disposed opposite to the jet nozzle 19 and is connected to the CPU 32 through a driving circuit 21. The printing paper 15 comes in contact with the roller 20. The ink droplet 8 is jetted from the jet nozzle 19 toward the printing paper 15 substantially where the printing paper 15 is backed by the roller 20. When the ink jet device 3 completes the printing of one line of the printing paper 15, the roller 20 feeds the printing paper 15 by one line in the arrow direction. The roller 20 and the driving circuit 21 are the feeding means of the invention.

Figure 2:
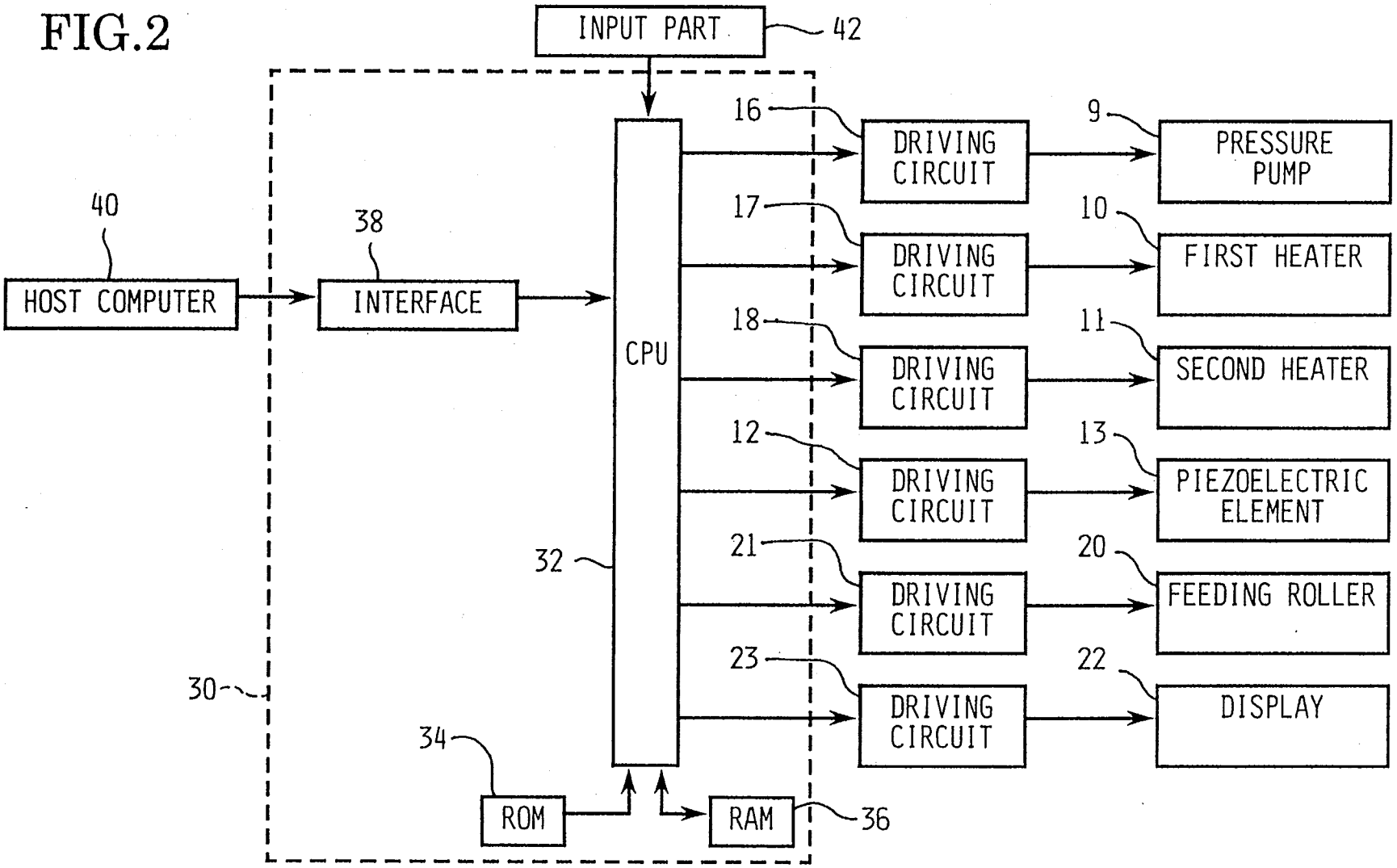
FIG. 2 is a block diagram showing the electrical structure of the ink jet printer comprising the ink jet device.

The electrical structure of the ink jet printer is shown in FIG. 2.

A liquid crystal display 22 displays various information to include an ink name input from an input part 42 to be described later. The display 22 is the display means of the invention.

The input part 42 comprises a panel switch and various keys, and is used for inputting the name of the ink 7 to be used as well as the first temperature and the second temperature of the ink 7. The input part 42 is the input means of the invention.

A control part 30 of the embodiment comprises a CPU (Central Processing Unit) 32, a ROM (Read Only Memory) 34 and a RAM (Random Access Memory) 36. The ROM 34 and the RAM 36 are connected to the CPU 32. Further, an interface 38 is connected to the CPU 32 and links the CPU to a host computer 40 so that data from the host computer 40 is input to the CPU 32 through the input interface 38.

The ROM 34 stores dot patterns corresponding to character codes, a printing processing program to be described, a program which is used when the CPU 32 controls each member, and the data used for the control operation. Further, the ROM 34 stores ROM table 34A, shown in FIG. 4.

The RAM 36 comprises a receive buffer which stores temporarily image data input from an external device, a host computer 40, and a print buffer which stores the dot pattern for one or more lines based on the image data. Further, the RAM 36 temporarily stores the data necessary for the CPU 32 to control each member, such as the first temperature and the second temperature.

The CPU 32 executes the print program and the control program which are stored in the ROM 34. Moreover, the print data, comprising character codes and control codes are input into the CPU 32 from the host computer 40 and stored in the RAM 36. The pressure pump 9, the first heater 10, the second heater 11, the piezoelectric element 13, the feeding roller 20 and the display 22 are connected to the CPU 32 through driving circuits 16, 17, 18, 12, 21 and 23, respectively. Moreover, the input part 42 is connected to the CPU 32. The CPU 32, the ROM 34 and the RAM 36 are the control means of the invention.

Figure 3:
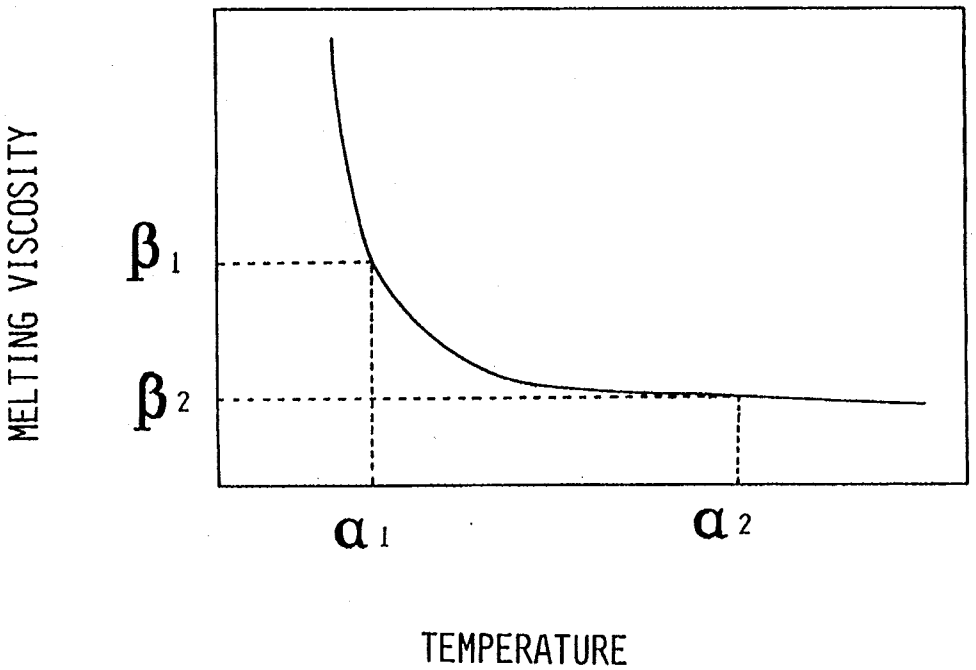
FIG. 3 is a graph showing the relationship between the melting viscosity of the heat melted ink and temperature.

Next, a method of determining heating temperatures of the first heater 10 and the second heater 11 of the present embodiment will be explained. FIG. 3 is a graph showing the relationship between the melting viscosity of an ink which is used as the heat melted ink and the temperature thereof. First, a jet viscosity $\beta 2$ of the ink 7 of the embodiment is determined based on the graph so as to get an optimum value according to the piezoelectric element 13 and the shape of the ink jet part 3D. The temperature $\alpha 2$ for the jet viscosity $\beta 2$ is set as a heating temperature for the second heater 11. Next, a supply viscosity $\beta 1$, which is a higher viscosity than the jet viscosity $\beta 2$, is determined. The temperature $\alpha 1$ for the supply viscosity $\beta 1$ is determined as a heating temperature for the first heater 10. Further, preferably, the heating temperature $\alpha 1$ of the first heater 10 is set such that the supply viscosity $\beta 1$ becomes a value which is more than ten times as high as the jet viscosity $\beta 2$. It is desirable the optimum value of the supply viscosity $\beta 1$ lies in the range 1000 cp (centipoise)$\leqq \alpha 1 \leqq$10000 cp and the jet viscosity $\beta 2$ lies in the range 1 cp$\leqq \beta 2 \leqq$100 cp. That is, the heating temperature $\alpha 1$ of the first heater 10 and the heating temperature $\alpha 2$ of the second heater 11 are determined so as to give the ink the above-mentioned viscosity values, respectively. If the jet viscosity $\beta 2$ is less than 1 cp or is more than 100 cp, a common piezoelectric element cannot provide an optimum jet energy to the ink 7. Therefore, printing with a high reliability cannot be executed. Moreover, if the supply viscosity $\beta 1$ is less than 1000 cp, in the case where the heat melted ink has a pigment as a color material, there is the possibility of causing subsidence and aggregation of the pigment. Moreover, if the supply viscosity $\beta 1$ is more than 10000 cp, it is difficult for the pressure pump 9 to supply the ink.

An example of a practical heat melted ink E which can be used in the ink jet device 3 of the embodiment will now be described. The ingredients of the ink E are:

Distearyl ketone . . . 90WT %

Ethylene-vinyl acetate copolymer . . . 5WT %

Carbon black . . . 5WT %

The melting point of the heat melted ink E made of Distearyl ketone (trade name KAO WAX T-1 made by Kao Corporation), Ethylene-vinyl acetate copolymer (trade name EVA210 made by Mitsui-Dupont Polychemicals Co., Ltd.) and Carbon black (trade name MA-100 made by Mitsubishi Kasei Corporation) is 81.3° C. When the temperature of the first heater 10 is set to be about 90° C., the viscosity of the ink E becomes about 1000 cp. Moreover, when the temperature of the second heater 11 is set to be about 110° C., the viscosity of the ink E becomes about 20 cp.

Figure 5:
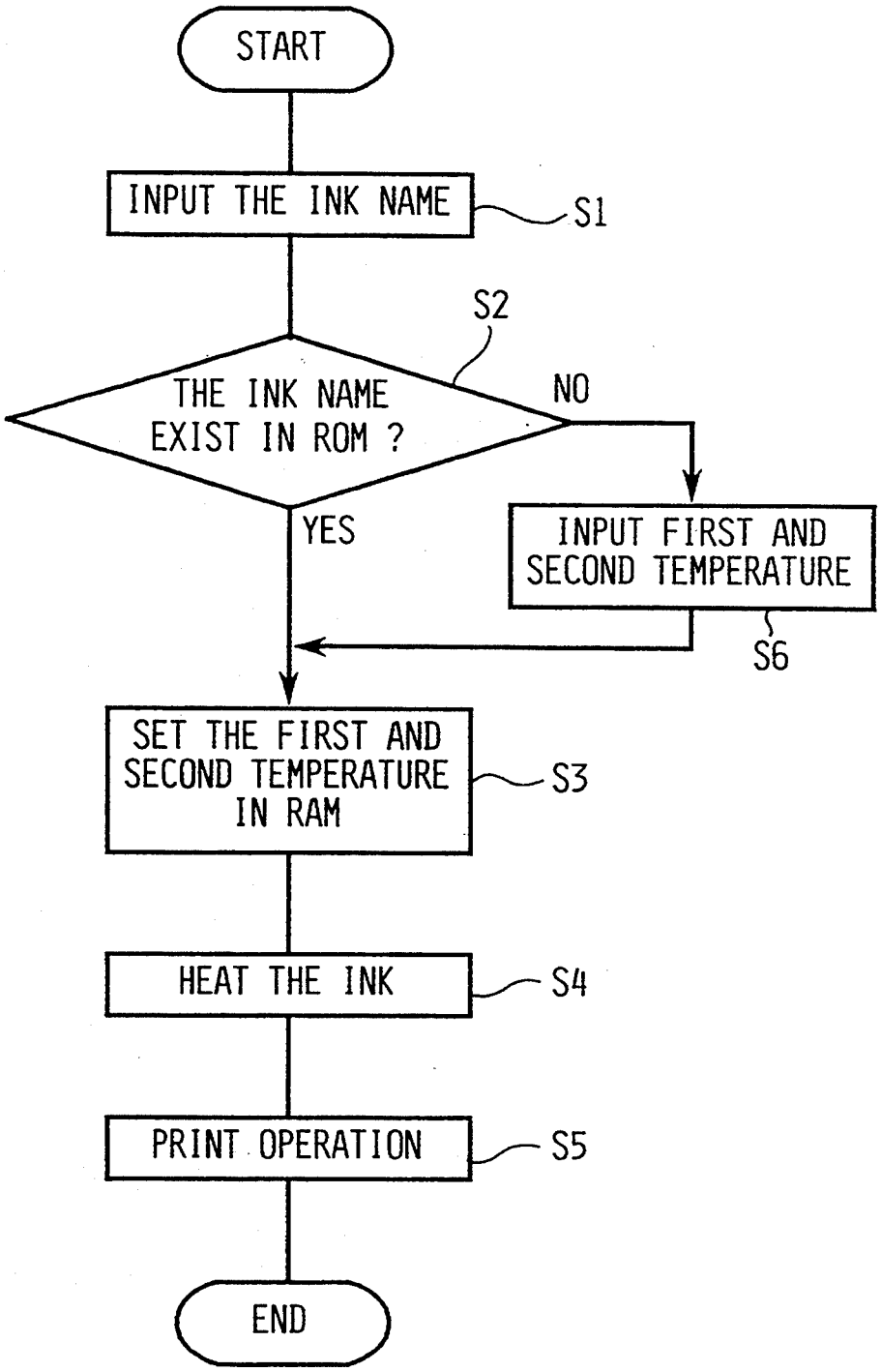
FIG. 5 is a flowchart showing an operation of the ink jet printer of the invention.

The operation of the ink jet printer employing the ink jet device 3 of the embodiment will be explained with reference to FIG. 5. The flowchart of the FIG. 5 starts from the point in time that the user supplies new heat melted ink into the ink jet device 3.

First, the user turns on a power supply (not shown) and inputs the name A of the ink supplied to the ink jet device 3 from the input part 42 (Step 1, hereafter referred to as S1, similarly, to as S2, S3 .. .). The CPU 32 determines whether the ink name A, input from the input part 42, exists in the ROM table 34A stored in the ROM 34. Since the ink A is stored in the ROM table 34A, the CPU 32 determines that the ink name A input from the input part 42 exists in the ROM table 34A (S2:Yes). The CPU 32 then reads out the first temperature A1 and the second temperature A2 from the ROM table 34A and stores them in the RAM 36 (S3). Further, the CPU 32 drives the first heater 10 and the second heater 11 through the driving circuits 17, 18 respectively, in accordance with the temperatures stored in RAM 36. The first heater 10 and the second heater 11 are heated as a result to the first temperature A1 and the second temperature A2, respectively, set in the RAM 36. The ink A supplied to the ink supply part 3B is heated by the first heater 10 of the ink supply channel 3C until the ink A reaches the temperature A1 and melts to have a high viscosity. The ink A is then supplied to the ink jet part 3D by the pressure pump 9 and the ink A is heated by the second heater 11 until the ink A reaches the second temperature A2 (S4). At this time, when the image data and the print instruction are transmitted from the host computer, the CPU 32 drives the piezoelectric element 13, based on the image data, to print the input characters and images on the print paper 15 as the recording medium (S5).

In the case where the user supplies an ink E, that is not found in ROM table 34A, into the ink jet device 3 will now be explained. At this time, the user inputs the name of the ink E using the input part 42 and the CPU 32 determines that the ink E does not exist in the ROM table 34A (S2:No). Next, the CPU 32 drives the display 22 through the driving circuit 23 such that the display 22 displays a message "input the first temperature". The user inputs the first temperature 90° C. for the ink supplied to the ink jet device 3 using the input part 42. After the first temperature, such as 90° C., is input, the CPU 32 controls the display 22 to display a message "input the second temperature". When the user inputs the second temperature, such as 110° C., using the input part 42 (S6), the CPU 32 stores the input first temperature, 90° C., and the second temperature, 110° C., into the RAM 36. As described above, the CPU 32 heats the ink E using the first heater 10 in the ink supply channel 3C until the ink E reaches 90° C. and further, heats the ink E using the second heater 11 in the ink jet part 3D until the ink E reaches 110° C. (S4). When the image data and the print instruction are transmitted from the host computer, the CPU 32 drives the piezoelectric element 13, based on the image data, and prints the characters and images on the print paper 15 (S5).

According to the embodiment, the heat melted ink 7 is not kept under low viscosity melting conditions, that is, the ink 7 is not kept at a high temperature for a long period of time. Therefore, the ink composition is not deteriorated by the heat. As a result, printing with a high stability and reliability can be executed and, further, the ink is supplied smoothly. Moreover, even if an ink having a pigment as a color material is used, printing with high stability and reliability can be executed because subsidence and aggregation of the pigment do not result, during the ink flow in the ink supply channel 3C, because of a high viscosity of the ink. Therefore, it is possible to use an ink having poor durability at high temperatures.

The invention is not limited to the above-mentioned embodiment. It should be understood that many changes and modifications may be made in the embodiment without departing from the scope of the invention.

For instance, in the embodiment, the ink 7 is jetted from the ink jet part 3D by the piezoelectric element 13. A heating element may be used, instead of the piezoelectric element 13, to use heat energy as the jet power source.

Moreover, a difference in elevation instead of the pressure pump 9 may be used to generate a position energy as an ink movement power source. According to the above-mentioned modifications, the mechanism of the main body can be simplified.

Further, it may that the user inputs the first and second temperatures from the input part 42 without using the ROM table 34A.

It may also be that the ink jet printer of the invention employs only one type of ink in order to predetermine the first temperature and the second temperature in the ROM 34.

In the embodiment, a single first heater 10 and a single second heater 11 are provided. However, it may be that two or more first heaters 10 and/or two or more second heaters 11 are provided.

What is claimed is:

1. An ink jet device provided in an ink jet printer employing heat melted ink which is in a solid state under a normal temperature and is melted by heating, the ink jet device comprising:

an ink supply part for supplying heat melted ink under a first viscosity condition;

an ink jet part connected to said ink supply part that is able to jet the ink after heating the heat melted ink supplied from said ink supply part to a second viscosity condition, wherein the second viscosity condition has a lower value than that of the first viscosity condition; and an insulated member which is provided around a connection part between said ink supply part and said ink jet part, said insulated member preventing a temperature of said ink jet part from being conducted to said ink supply part.

2. The ink jet device according to claim 1, wherein said ink jet part comprises:

a jet nozzle for jetting ink; and jetting power supply means for supplying jetting power to the ink.

3. The ink jet device according to claim 1, further comprising:

first heating means for heating ink to the first viscosity by heating said ink supply part at a first temperature; and second heating means for heating ink to the second viscosity, which has the lower value than that of the first viscosity, by heating said ink jet part at a second temperature higher than the first temperature.

4. The ink jet device according to claim 1, wherein the first viscosity is in a range from 1,000 cp to 10,000 cp and the second viscosity is in a range from 1 cp to 100 cp.

5. An ink jet device provided in an ink jet printer employing heat melted ink which is in a solid state under a normal temperature and is melted by heating, the ink jet device comprising:

an ink jet chamber which is capable of storing melted heat melted ink;

an ink supply channel which supplies melted heat melted ink to said ink jet chamber;

first heating means for heating heat melted ink to a first viscosity condition which is capable of flowing, said first heating means being provided at said ink supply channel;

pressure means for causing the flow of heat melted ink in the first viscosity condition into said ink jet chamber;

second heating means for further heating the heat melted ink in the first viscosity condition to a second viscosity condition which is capable of jetting;

jetting means for jetting heat melted ink in the second viscosity condition from said ink jet chamber;

a connection part between said ink supply channel and said ink jet chamber; and means for preventing the heat from said ink let chamber from being conducted to said ink supply channel, said means for preventing being adjacent to said connection part.

6. The ink jet device according to claim 5, wherein said means for preventing being adjacent to said connection part comprises an insulated member which is provided around said connection part.

7. An ink jet printer for recording an image on a recording medium using heat melted ink, said heat melted ink being in a solid state under a normal temperature and being melted by heating, said ink jet printer comprising:

an ink supply part for supplying heat melted ink under a first viscosity condition;

an ink jet part which is connected to said ink supply part and is able to jet the ink after bringing the heat melted ink supplied from said ink supply part to a second viscosity condition whose viscosity is a lower value than that of the first viscosity condition;

feeding means for feeding the recording medium on which the image is recorded by the heat melted ink jetted from said ink jet part, said feeding means being provided opposite to said ink jet part with a predetermined interval through which the recording medium can pass;

first heating means for heating ink to the first viscosity by heating said ink supply part at a first temperature;

second heating means for heating ink to the second viscosity which has a lower value than that of the first viscosity by heating said ink jet part at a second temperature higher than the first temperature;

means for providing ink data representing a type of heat melted ink;

control means for driving said first heating means to heat the heat melted ink with the first viscosity condition and for driving said second heating means to heat the heat melted ink with the second viscosity condition, wherein said control means comprises memory means for storing plural heat control data; and means for selecting a desired heat control data from said plural heat control data based on the ink data, said first heating means and said second heating means being driven based on the selected heat control data.

8. The ink jet printer according to claim 7, wherein said ink jet part comprises:

a jet nozzle jetting ink; and jetting power supply means for supplying jetting power to the ink.

9. The ink jet printer according to claim 7, wherein the first viscosity is in a range from 1,000 cp to 10,000 cp and the second viscosity is in a range from 1 cp to 100 cp.

10. The ink jet printer according to claim 7, further comprising:

a connection part between said ink supply part and said ink jet part; and an insulated member which is provided around said connection part, said insulated member preventing the second temperature of said ink jet part from being conducted to said ink supply part.

11. The ink jet printer according to claim 7, wherein said memory means comprises:

first memory means for storing the first temperature and the second temperature of at least one kind of heat melted ink and for storing a control program which controls the ink jet printer; and second memory means for temporarily storing the first temperature and the second temperature read out from said first memory means.

12. The ink jet printer according to claim 11, further comprising inputting means for inputting at least one of the name of heat melted ink, the first temperature and the second temperature.

13. The ink jet printer according to claim 12, further comprising display means for displaying a display consisting of one of the name of heat melted ink, the first temperature and the second temperature input from said inputting means, and instructions to input the first and second temperatures.

14. The ink jet printer according to claim 13, further comprising pressure means for applying pressure to the melted heat melted ink stored in said ink supply part to cause the melted heat melted ink to be supplied to said ink jet part.

* * * * *